US007435135B2

(12) United States Patent
Wlos

(10) Patent No.: US 7,435,135 B2
(45) **Date of Patent: *Oct. 14, 2008**

(54) ANNULAR CORRUGATED COAXIAL CABLE CONNECTOR WITH POLYMERIC SPRING FINGER NUT

(75) Inventor: James Wlos, Crete, IL (US)

(73) Assignee: Andrew Corporation, Westchester, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/672,631

(22) Filed: Feb. 8, 2007

(65) Prior Publication Data

US 2008/0194142 A1 Aug. 14, 2008

(51) Int. Cl.
*H01R 9/05* (2006.01)

(52) U.S. Cl. ..... 439/584; 439/583; 439/578; 439/277

(58) Field of Classification Search ..... 439/578, 439/583, 584, 277
See application file for complete search history.

(56) References Cited

U.S. PATENT DOCUMENTS 3,206,540 A * 9/1965 Cohen ..... 174/89
3,634,815 A * 1/1972 Stevens et al. ..... 439/583
4,046,451 A * 9/1977 Juds et al. ..... 439/583
4,834,675 A * 5/1989 Samchisen ..... 439/578
5,154,636 A 10/1992 Vaccaro et al.
5,354,217 A 10/1994 Gabel et al.
5,595,502 A * 1/1997 Allison ..... 439/429
5,844,021 A * 12/1998 Koblitz et al. ..... 523/173
6,133,532 A 10/2000 Lundback et al.
6,217,384 B1 * 4/2001 Strasser et al. ..... 439/583
6,267,621 B1 * 7/2001 Pitschi et al. ..... 439/584
6,383,019 B1 * 5/2002 Wild ..... 439/578
6,386,915 B1 5/2002 Nelson
6,607,398 B2 8/2003 Henningsen
6,776,637 B2 * 8/2004 Yamada et al. ..... 439/247
7,275,957 B1 * 10/2007 Wlos et al. ..... 439/583
2007/0224880 A1 * 9/2007 Wlos et al. ..... 439/578

* cited by examiner

*Primary Examiner*—Renee Luebke
*Assistant Examiner*—Vanessa Girardi
(74) *Attorney, Agent, or Firm*—Babcock IP, PLLC

(57) ABSTRACT

An annular corrugated solid outer conductor coaxial cable electrical connector with an integral spring finger nut telescopically coupled via threads to the cable end of a body. A nut bore in the spring finger nut dimensioned to receive the outer conductor therethrough. A plurality of spring fingers around the periphery of the interface end of the nut bore, projecting towards the interface end, the spring fingers provided with an inward projecting bead at the interface end. the interface end of the spring fingers initially deflectable into an annular groove open to the interface end between the spring fingers and an outer diameter of the spring finger nut.

21 Claims, 4 Drawing Sheets

ANNULAR CORRUGATED COAXIAL CABLE CONNECTOR WITH POLYMERIC SPRING FINGER NUT

BACKGROUND OF INVENTION

1. Field of the Invention

The invention relates to an electrical connector. More particularly the invention relates to a lightweight and cost efficient annular corrugated coaxial cable electrical connector with a polymeric material coupling nut.

2. Description of Related Art

Connectors for corrugated outer conductor cable are used throughout the semi-flexible corrugated coaxial cable industry. Connectors for solid outer annular corrugated outer conductor coaxial cable, for example as disclosed in U.S. Pat. No. 4,046,451, issued Sep. 6, 1977 to Juds et al, attach using mechanical compression between a body and a spring finger nut having spring fingers that clamp a leading edge of the outer conductor against an angled contact surface of the connector body. The spring fingers are outward deflectable, allowing the spring finger nut to be placed over the cable end, positioning the spring finger ends in a trough behind the lead corrugation peak of the outer conductor, before threading the connector body onto the spring finger nut. U.S. Pat. No. 4,046,451 is formed from metal material using metal machining techniques. A significant cost factor of this design is both the metal material and the numerous metal machining steps required during manufacture.

A previous application of polymeric materials to a coaxial connector for use with helical corrugated solid outer conductor coaxial cable is disclosed in U.S. Pat. No. 5,354,217, issued Oct. 11, 1994 to Gabel et al. Polymeric materials are used for both the connector body and a clamp nut, requiring multiple internal conductive elements to form a conductive path for the outer conductor across the connector. The clamp nut threads upon helical corrugations of the outer conductor and the leading edge of the outer conductor is then manually flared against the clamp nut prior to connector assembly. Therefore, the connector is incompatible with annular corrugated solid outer conductor coaxial cable, is expensive to manufacture and time consuming to install.

Both of the prior connectors described herein above also require separation of the connector elements during cable connection. Because cable connection may occur in hazardous locations such as high atop an antenna tower, separation of the connector and any additional required assembly operations creates a significant drop hazard and or installation burden for the installation personnel.

Competition within the cable and connector industry has increased the importance of minimizing connector weight, installation time, overall number of discrete connector parts and connector manufacturing/materials costs. Also, competition has focused attention upon ease of use, electrical interconnection quality and connector reliability.

Therefore, it is an object of the invention to provide an electrical connector and method of installation that overcomes deficiencies in such prior art.

BRIEF DESCRIPTION OF DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

Figure 1:
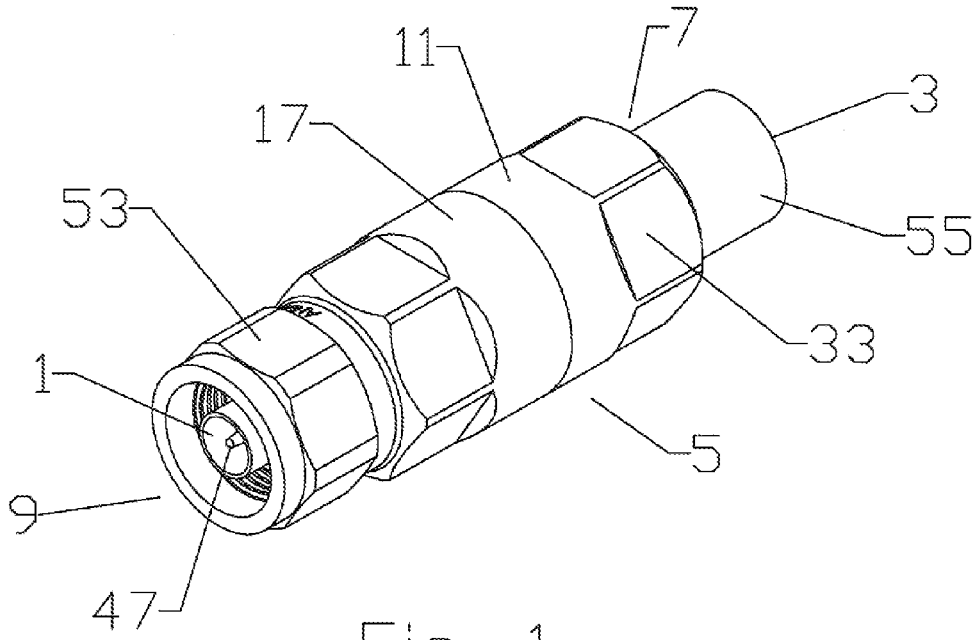
FIG. 1 is an external isometric view of a connector according to a first embodiment of the invention, the connector shown mounted upon a coaxial cable.

The inventor has recognized that a spring finger nut element of a connector according to the invention may be formed from a polymeric material via injection molding to eliminate the numerous required metal machining steps and significantly reduce materials costs and component weight. Although the connector body of a connector according to the invention may also be formed partially or completely from polymeric material, for example via overmolding or application of an internal conductive coating or separate internal conductive element, where only the metal spring finger nut is formed from polymeric material, the requirement for and associated complexities of an additional internal outer conductor conductive structure is eliminated.

The invention will be described in detail with respect to FIGS. 1-7, demonstrating an exemplary embodiment having a standard Type-N connector interface 1 for use with an annular corrugated solid outer conductor coaxial cable 3. One skilled in the art will appreciate that the invention, as will be discussed herein below, is similarly applicable to other standard or proprietary connector interface(s) and annular corrugated solid outer conductor coaxial cables of varied dimensions. For clarity of description, the connector 5 and the sub-elements thereof each will be described with reference to a cable end 7 and an interface end 9.

Figure 2:
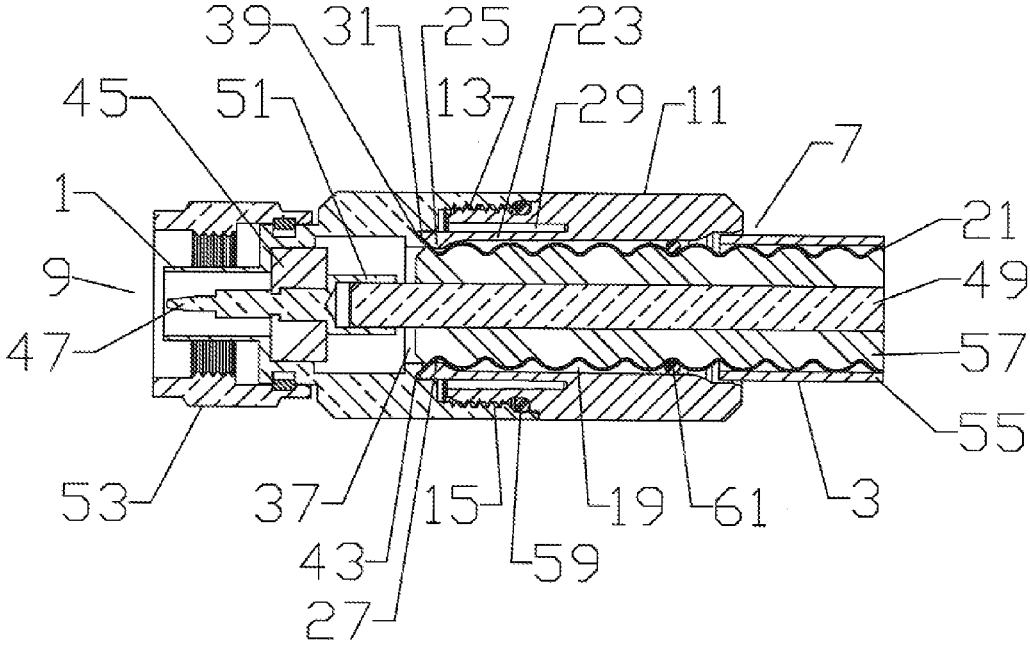
FIG. 2 is a cross sectional side view of FIG. 1.

As shown in FIGS. 1 and 2, assembled upon an annular corrugated solid outer conductor coaxial cable 3, a connector 5 comprises a spring finger nut 11 with an outer diameter thread 13 that mates with an inner diameter thread 15 of a body 17.

Figure 3:
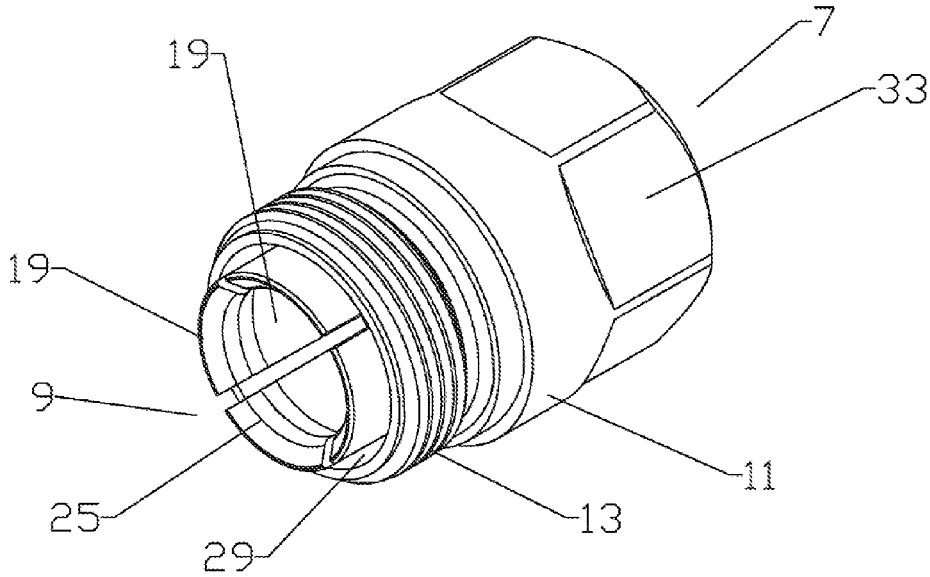
FIG. 3 is external isometric view of the spring finger nut of FIG. 1.
Figure 4:
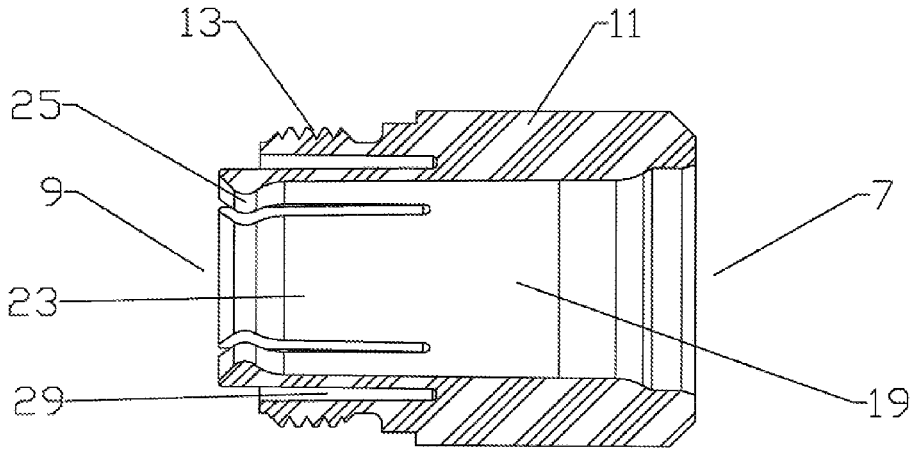
FIG. 4 is a cross sectional side view of FIG. 3.

As best shown in FIGS. 3 and 4, the spring finger nut 11 has a nut bore 19 dimensioned to receive the outer conductor 21 of the annular corrugated solid outer conductor coaxial cable 3. Spring finger(s) 23 formed along a periphery of the interface end 9 of the nut bore 19 extend generally parallel to a longitudinal axis of the connector 5 toward an interface end 9 of the spring finger nut 11.

The spring finger nut 11 may be formed from a polymeric material such as polybutylene terephthalate (PBT) plastic resin. The PBT or other selected polymeric material may be injection molded and or machined. Carbon black or the like may be added to the PBT or other selected polymeric material to improve a UV radiation resistance characteristic of the polymeric material. Because the polymeric material can be expected to have an increased flexibility characteristic compared to the prior brass or the like metal material of the same thickness, the number of sections applied to form the individual spring fingers may be reduced, further reducing both injection mold cost and mold separation problems during manufacture. For example, a total of four or less individual spring finger(s) 23 may be applied, the width of the selected number of spring fingers preferably adjusted to surround the nut bore.

Each of the spring finger(s) 23 has an inward projecting bead 25 at the distal end. The dimensions of the inward projecting bead 25 are selected to mate with a corrugation trough 27 of the outer conductor 21. An annular groove 29 open to the interface end 9 provides a deflection space for the distal end of the spring finger(s) 23.

Because injection molding of the spring finger nut 11 allows the annular groove 29 to be easily formed with a considerable depth, for example extending towards the cable end 7 to the base of the spring finger(s) 23, the deflection space is provided without requiring location of the outer diameter thread 13 towards the cable end of the spring finger nut 11. Therefore, the length of the body 17 and thereby the amount of metal material required to position the inner diameter thread 15 to mate with the outer diameter thread 13 is significantly reduced.

As the outer conductor 21 is inserted into the cable end 7 of the nut bore 19, the spring finger(s) 23 momentarily deflect into the annular groove 29 to allow the inward projecting bead(s) 25 to pass over the lead corrugation 31 of the outer conductor 21 and into the corrugation trough 27 immediately behind it. Flat(s) 33 or other form of hand or tool gripping surface may be formed in the outer diameter of the spring finger nut 11 for ease of threading the body 17 onto the spring finger nut 11.

Figure 5:
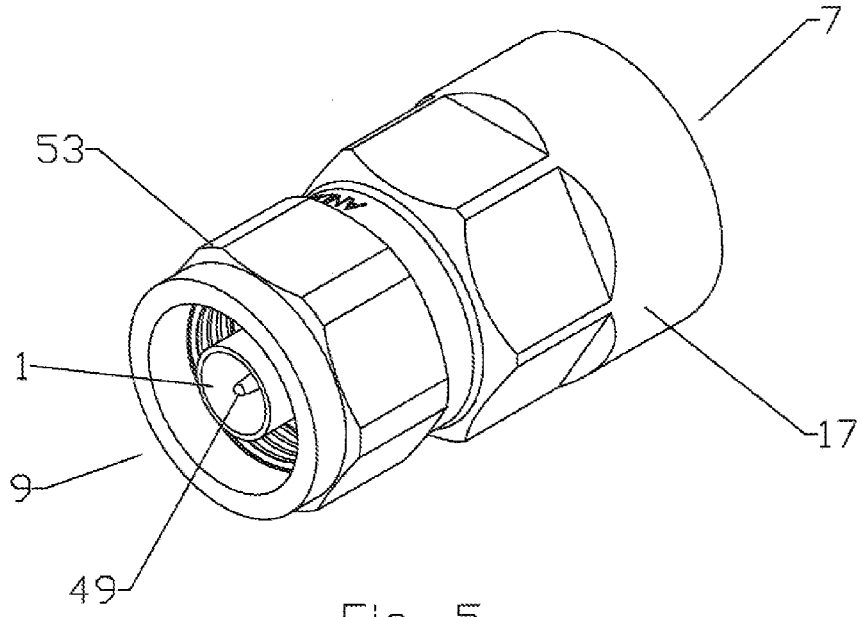
FIG. 5 is external isometric view of the body of FIG. 1.
Figure 6:
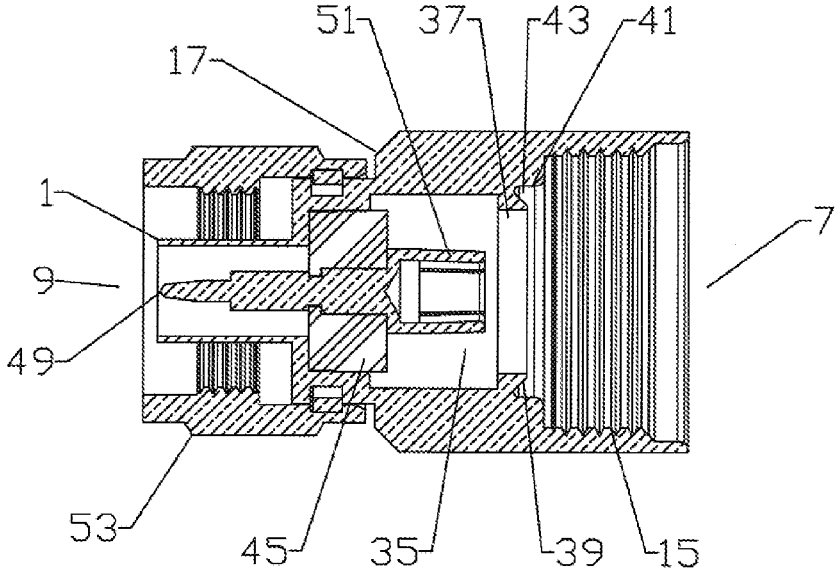
FIG. 6 is a cross sectional side view of FIG. 5.

The body 17, best shown in FIGS. 5 and 6, has a body bore 35 with an inward projecting shoulder 37 provided with an angled flare seat 39 and adjacent retaining lip 41 proximate the interface end 9 of the inner diameter threads 15. The flare seat 39 and retaining lip 41 together form an outer conductor groove 43 open to the cable end 7 of body 17.

An insulator 45 holds a center contact 47 coaxial within the body bore 35. For coaxial cable 3 with a solid inner conductor 49, a spring basket 51 at the cable end 7 of the center contact 47 is inwardly biased to electrically contact and retain an inner conductor 49 of the coaxial cable 3 upon insertion. Alternatively, any form of center contact 47 selected to make secure contact with the inner conductor 49 may be applied. For example, where the inner conductor 49 is hollow, any of the spring or threaded type center contacts that insert within and engage the sidewalls of the hollow inner conductor 49 may be selected. The connector interface 1 and associated coupling nut 53 (if required by the connector interface 1 that is selected) are located at the interface end 9 of the body 17.

Figure 7:
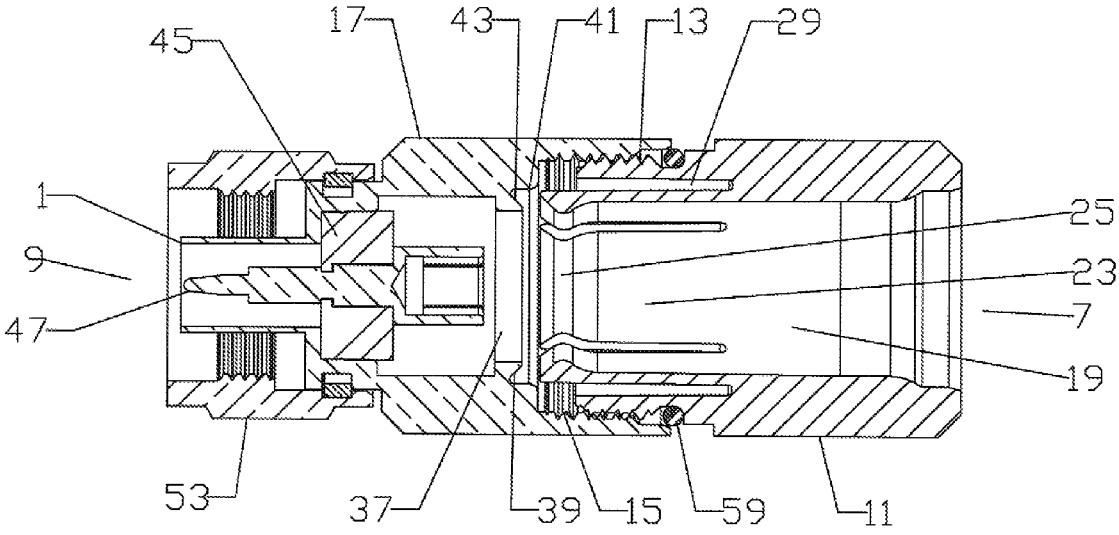
FIG. 7 is a cross sectional side view of a connector according to a first embodiment of the invention, in a preliminary threaded configuration, ready for cable insertion.

As shown in FIG. 7, a connector 5 according to the invention is ready for installation upon a coaxial cable 3 without requiring separation of the body 17 from the spring finger nut 11. The body 17 and spring finger nut 11 are coupled together by the threading together of the outer diameter thread 13 and inner diameter thread 15 to a preliminary threaded position that joins the spring finger nut 11 and body 17, but locates the distal end of the spring finger(s) 23 spaced away from the retaining lip 41.

A connector 5 according to the invention is mounted according to the following procedure. A coaxial cable 3 is stripped back to expose the desired length of inner conductor 49 from the outer conductor 21 and the outer sheath 55, if any, is removed from a desired length of the outer conductor 21. The coaxial cable 3 is then inserted into the nut bore 19 at the cable end 7 of the connector 5. Because the preliminary threaded position locates the distal end of the spring finger(s) 23 spaced away from the retaining lip 41, as a leading edge of the outer conductor 21 contacts the inward projecting bead(s) 25 of the spring finger(s) 23, the spring finger(s) 23 are clear of the retaining lip 51, allowing the spring finger(s) 23 to be deflected outwards into the deflection space created by the annular groove 29, allowing the lead corrugation 31 of the outer conductor 21 to pass. As the lead corrugation 31 of the outer conductor 21 passes the inward projecting bead(s) 25 of the spring finger(s) 23, the spring finger(s) 23 return to a ready state, resting in the corrugation trough 27 behind the leading corrugation 21 of the outer conductor 47, retaining the outer conductor 21. At the same time, the inner conductor 49 is advanced to a position just short of entry into the spring basket 51 of the center contact 47.

To finally secure the connector 1 and coaxial cable 3 together, the spring finger nut 11 is threaded into the body 17. As the threading moves from the preliminary threaded position to a final threaded position, the distal end of the spring finger(s) 23 are moved under the retaining lip 51 and the lead corrugation 31 of the outer conductor 21 is moved into the outer conductor groove 43. As the body 17 and spring finger nut 11 are threaded closer to one another the retaining lip 51 moves towards and overlaps the interface end 9 of the spring finger(s) 23 preventing deflection up and away from the lead corrugation 31 and or flare seat 39. As the outer conductor groove 43 moves towards the cable end 19, the lead corrugation 31 of the outer conductor 21 engages the flare seat 39 and is flared up and away from the inner conductor 49 along the flare seat 39. At a final threaded position, the distal end of the spring finger(s) 23, retained against the outer conductor by the retaining lip 51, securely clamps the lead corrugation 31 of the outer conductor 21 against the flare seat 39, as shown in FIG. 2. Any dielectric insulation 57 between the inner and outer conductor(s) 49, 21 of the coaxial cable 3 is deformed downward and away from the outer conductor 21 providing a secure metal to metal contact between the flare seat 39 and the lead corrugation 31 of the outer conductor 21 around a 360 degree circumference. At the same time, the inner conductor 49 is advanced into the spring basket 51 of the center contact 47, creating a secure connection between the inner conductor 43 and the center contact 47.

Compressible and or deformable sealing gaskets, for example rubber or silicon o-rings, may be located around and within the connector 1 to environmentally seal the connecting surface(s). An interface gasket 59 may be located sealing overlapping surfaces of the body 17 and spring finger nut 11. Also, a cable gasket 61 may be seated in a corresponding annular corrugation of the outer conductor 21 between the cable end 7 of the spring finger nut 11 and the outer conductor 21.

Upon a review of this Specification, one skilled in the art will appreciate that the threading between the spring finger nut 11 and the body 17 described herein may be oriented in an alternative overlapping thread configuration wherein the spring finger nut 11 overlaps the body 17.

The invention provides an environmentally sealed connector 1 with improved cost efficiency and installation characteristics. Use of the polymeric material for the spring finger nut 11 reduces costs and overall connector weight, without impacting the electrical characteristics of the connection between the outer conductor and the body 17. The presence of the annular groove 29 shortens the required length of the body 17, further reducing metal material requirements and the overall weight of the connector. Because the factory pre-assembled connector 5 does not require any disassembly or other preparation before mounting upon a coaxial cable 3, drop hazard is reduced and the opportunity for losing or damaging an essential part of the connector 5 has been eliminated.

TABLE OF PARTS

1 connector interface
3 coaxial cable
5 connector
7 cable end
9 interface end
11 spring finger nut
13 outer diameter thread

15 inner diameter thread
17 body
19 nut bore
21 outer conductor
23 spring finger
25 bead
27 corrugation trough
29 annular groove
31 lead corrugation
33 flat
35 body bore
37 inward projecting shoulder
39 flare seat
41 retaining lip
43 outer conductor groove
45 insulator
47 center contact
49 inner conductor
51 spring basket
53 coupling nut
55 outer sheath
57 insulation
59 interface gasket
61 cable gasket Where in the foregoing description reference has been made to ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

The invention claimed is:

1. An annular corrugated solid outer conductor coaxial cable electrical connector, with an interface end and a cable end, comprising:

a monolithic spring finger nut telescopically coupled via threads to the cable end of a body;

a nut bore in the spring finger nut dimensioned to receive the outer conductor therethrough;

a plurality of spring fingers around the periphery of the interface end of the nut bore, projecting towards the interface end, the spring fingers provided with an inward projecting bead at the interface end;

the interface end of the spring fingers deflectable into an annular groove between the spring fingers and an outer diameter of the spring finger nut;

the annular groove open to the interface end.

2. The connector of claim 1, wherein the body has a body bore with an integral angled annular flare seat facing the cable end; the flare seat adjacent a retaining lip, the retaining lip projecting inward proximate an outer diameter of the spring fingers preventing deflection of the spring fingers into the annular groove when the telescopic coupling of the spring finger nut and the body toward one another overlaps the retaining lip and the interface end of the spring fingers.

3. The connector of claim 1, wherein the spring finger nut is a polymeric material.

4. The connector of claim 1, wherein the annular groove extends to the cable end of the spring fingers.

5. An electrical connector, with an interface end and a cable end, for annular corrugated solid outer conductor coaxial cable, comprising:

an integral body with an inner diameter thread around a cable end of a body bore; the body bore having an annular outer conductor groove formed between an angled annular flare seat and a retaining lip projecting inward from the interface end of the inner diameter thread;

the annular outer conductor groove open to the cable end; and a monolithic spring finger nut with an outer diameter thread threadable upon the inner diameter thread;

the spring finger nut provided with a nut bore dimensioned to receive the outer conductor and a plurality of spring fingers around the periphery of the nut bore, the spring fingers extending towards the interface end;

the spring fingers provided with an inward projecting bead at the interface end;

the interface end of the spring fingers deflectable into an annular groove, open to the interface end, between the spring fingers and the inner diameter thread, until the inner diameter thread is advanced along the outer diameter thread and the retaining lip overlaps the interface end of the spring fingers.

6. The connector of claim 5, wherein the plurality of spring fingers is four or less.

7. The connector of claim 5, wherein the annular groove extends to a cable end of the spring fingers.

8. The connector of claim 5, further including a center pin coaxially supported within a bore of the interface by an insulator, the center pin having a spring basket at the cable end.

9. The connector of claim 5, wherein the interface end of the outer diameter thread is located proximate the interface end of the spring finger nut.

10. The connector of claim 9, wherein the interface end of the outer diameter thread is located at a longitudinal position proximate the inward projecting bead(s).

11. A method for manufacturing an annular corrugated solid outer conductor coaxial cable electrical connector having an interface end and a cable end, comprising the steps of:

forming a body;

forming monolithic spring finger nut from a polymeric material;

the spring finger nut having a nut bore dimensioned to receive the outer conductor therethrough; the spring finger nut formed with a plurality of spring fingers around the periphery of the interface end of the nut bore, projecting towards the interface end, the spring fingers provided with an inward projecting bead at the interface end;

the spring finger nut formed with an annular groove, open to the interface end, between the spring fingers and an outer diameter of the spring finger nut; and coupling the interface end of the spring finger nut to the cable end of the body via threads.

12. The method of claim 11, wherein the spring finger nut is formed by injection molding.

13. The method of claim 11, wherein the polymeric material is polybutylene terephthalate.

14. The method of claim 11, further including the steps of:

forming the body with a body bore with an integral angled annular flare seat facing the cable end; the flare seat adjacent a retaining lip, the retaining lip projecting inward proximate an outer diameter of the spring fingers preventing deflection of the spring fingers into the annular groove when the coupling of the spring finger nut to the body advances the spring finger nut towards the body and the retaining lip overlaps the interface end of the spring fingers.

15. The method of claim 11, wherein the annular groove is formed with a depth corresponding to the cable end of the spring fingers.

16. The method of claim 11, wherein the number of spring fingers is four or less.

17. A method for manufacturing a spring finger nut having an interface end and a cable end, comprising the steps of:

forming the spring finger nut as a monolithic body from a polymeric material;

the spring finger nut having a nut bore therethrough;

the spring finger nut formed with a plurality of spring fingers around the periphery of the interface end of the nut bore, projecting towards the interface end, the spring fingers provided with an inward projecting bead at the interface end;

the spring finger nut formed with an annular groove, open to the interface end, between the spring fingers and an outer diameter of the spring finger nut.

18. The method of claim 17, wherein the forming of the spring finger nut is via injection molding.

19. The method of claim 17, wherein the number of spring fingers is four or less.

20. The method of claim 17, wherein a thread is formed at the interface end of the outer diameter.

21. The method of claim 20, wherein the thread extends to a longitudinal position proximate the inward projecting bead.

* * * * *